United States Patent [19]

Deman et al.

[11] 4,158,749

[45] Jun. 19, 1979

[54] ARRANGEMENT FOR DISCRIMINATING SPEECH SIGNALS FROM NOISE

[75] Inventors: Pierre Deman; Jean Potage, both of Paris, France

[73] Assignee: Thomson-CSF, Paris, France

[21] Appl. No.: 875,679

[22] Filed: Feb. 6, 1978

[30] Foreign Application Priority Data

Feb. 9, 1977 [FR] France ..... 77 03606

[51] Int. Cl.[2] ..... G10L 1/00

[52] U.S. Cl. ..... 179/1 SC; 179/1 VC

[58] Field of Search ..... 179/1 SC, 1 P, 1 VC, 179/1 VL

[56] References Cited

U.S. PATENT DOCUMENTS

| | | | |
|---|---|---|---|
| 3,944,753 | 3/1976 | Proctor et al. | 179/1 P |
| 4,001,505 | 1/1977 | Araseki et al. | 179/1 SC |
| 4,027,102 | 4/1977 | Ando et al. | 179/1 SC |

*Primary Examiner*—Kathleen H. Claffy
*Assistant Examiner*—E. S. Kemeny
*Attorney, Agent, or Firm*—Cushman, Darby & Cushman

[57] ABSTRACT

An audio squelch circuit uses spectral analysis of the audio signal to derive two test signals, one of the two indicating speech presence "energy" and the other "voiced" speech presence. The two test signals are logic-AND combined to decide speech presence and open the squelch gate. Detection of speech in the audio signal, composed of a voiced segment which is both preceded and followed by a non-voiced (consonant) segment, is improved by correspondingly lengthening the "voiced" test signal pulse with both earlier (anticipatory) initiation by a time interval "D," and with a later (prolonged) completion by a time interval "d".

4 Claims, 2 Drawing Figures

ARRANGEMENT FOR DISCRIMINATING SPEECH SIGNALS FROM NOISE

This invention relates to an arrangement for discriminating from noise the speech signals included in an input signal, this arrangement supplying a decision signal, for example for controlling a switch.

Simple arrangements of this type use a criterion which, although well defined as a function of time, is only presumptive; this criterion is energetic, i.e. based on the energy or the amplitude of the signal in at least one frequency band.

In order to limit the number of speech truncations, the cut-off time constant in a transmission system is lengthened which makes the conversation difficult on a two way simplex connection.

More complex arrangements which are not attended by the disadvantages referred to above use a delay of the input signal and an extremely elaborate decision circuit which necessitates a computer.

The present invention relates to an arrangement for discriminating speech signals from noise which arrangement also uses a delay of the input signal, but only a decision circuit which remains relatively simple while, at the same time, affording an extremely adequate degree of certainty in practice.

The invention enhances detection of speech if such speech starts with the sequence of sounds: unvoiced consonant/voiced vowel/unvoiced consonant. The time interval during which the voiced vowel is present is indicated by the presence of "voiced" test signal which is correspondingly derived by spectral analysis of the input audio signal. To enhance detection of speech presence during the entire sequence of sounds, logic circuits extend the "voiced" test signal both forward in time for "D" milliseconds (anticipating), and backward in time for "d" milliseconds (prolonging), to cover the intervals of the adjacent unvoiced consonants. The input audio signal is delayed to allow the "anticipating". Another test signal, the "energy" test signal, is derived from the delayed input audio signal to indicate the presence of speech which is either voiced or unvoiced. Both the "energy" and extended "voiced" test signals are logic-AND compared to decide speech presence and operate a switch such as a squelch gate.

The invention will be better understood from the following description in conjunction with the accompanying drawings, wherein.

It will first of all be recalled that a voiced sound in a speech signal is formed either by a vowel or by a liquid or voiced consonant.

The voiced sounds have well defined spectral properties which are not encountered in the unvoiced sounds formed by the mute consonants.

Figure 1:
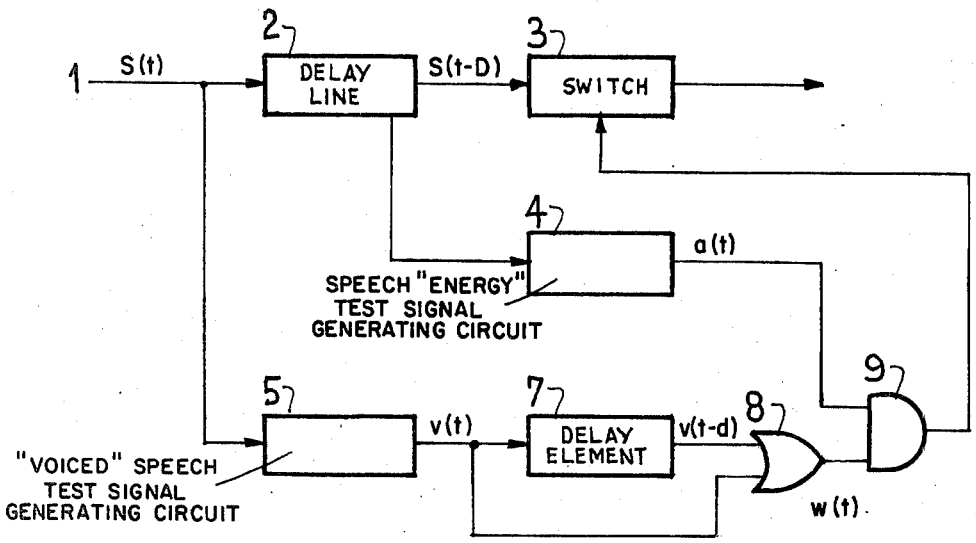
FIG. 1 is a basic circuit diagram.

In FIG. 1, the input 1 receives an input signal formed by a speech signal mixed with noise, the input 1 is connected to a delay line 2 introducing a delay D, preferably in the form of a charge transfer device. The output of the delay line 2 is connected to the signal input of a switch 3.

If the input signal is designated S(t), the output signal of the delay line is S(t−D).

The decision is taken on the delayed input signal by means of a first test signal of energetic character A relative to the delayed input signal S(t−D) and a second signal W formed by a test signal V produced by means of the input signal and prolonged by a time d, the signal V denoting (disregarding the response time of the circuit producing it) a voiced sound in the input signal.

The time D is selected so as to cover the time required for the auditive identification of a mute consonant preceding a voiced sound and the aforementioned response time, D being for example equal to 40 ms.

Duration d is taken sufficiently high for the end of the time interval during which the signals in response to which the second test signal was generated, to precede the end of the prolonged second test signal by a duration allowing the auditive identification of an unvoiced consonant following a voiced sound.

Signals A, V and W are formed by levels 1 of corresponding logical signals a(t), v(t) and w(t).

The first test signal is produced in a test signal generator circuit 4 fed by the delay line.

The response time of the circuit producing the energetic signal is short, in the order of a few milliseconds, and may be compensated by extracting the signal for generating it, a little before the output of the delay line.

The signal w(t) is produced by means of a test signal generator circuit 5 fed by the input signal S(t) and supplying the signal v(t), a delay element 7 which retards this signal by a time d and which supplies v(t−d), and a gate 8 performing the logic operation OR on the delayed signal v and the non-delayed signal v. Since the emission time of a voiced sound is longer than d, the signal w(t), whose level 1, W, is the prolonged signal V, is thus obtained.

The outputs of the circuit 4 and the gate 8 are connected to the two inputs of an AND-gate 9 of which the output, connected to the control input of the switch 3, transmits the delayed speech signal when the gate 9 applies the level 1 to it.

Figure 2:
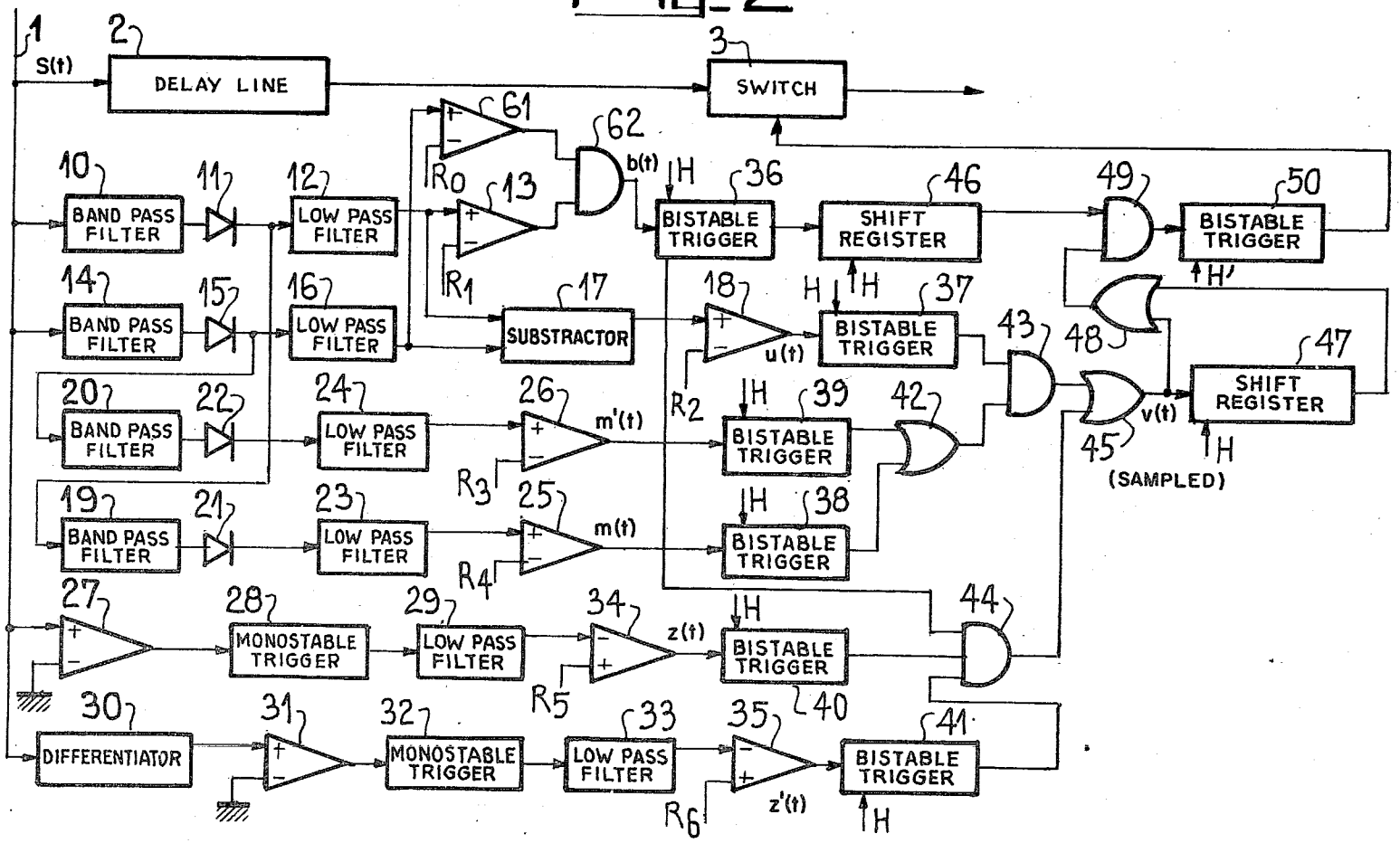
FIG. 2 is a detailed circuit diagram of a preferred embodiment of the arrangement according to the invention.

FIG. 2 shows in detail a discriminating arrangement using minimal energies in the 300–900 c/s and 1200–3400 c/s bands as the first test signal A. The test signal A corresponds to the logic level 1 of a corresponding logic signal a(t).

For reasons which will become apparent, a(t), which is to apply to the delayed input signal S(t−D), is obtained here by delaying by D′ a corresponding signal b(t) produced by means of S(t), time D′ differing from D to take into account the response time of the circuit generating b(t) and the sampling mentioned later on. B will designate level 1 of signal b(t).

The second test signal is a combination of several elementary test signals of which each is represented by the level 1 of a corresponding logic signal.

The test criteria indicated hereinafter are intended to serve purely as examples. A simplified version may be confined to a limited number of them, of which at least one is characteristic of the voiced speech, whilst a more elaborate version may use a combination of a larger number of speech recognition criteria.

The criteria used in this example are as follows:

U: energy lack of balance above a certain threshold between the 300–900 c/s and 1200–3400 c/s bands.

M: the presence of a modulation comprised between 70 and 300 c/s in the 300–900 c/s band.

M′: the presence of a modulation comprised between 70 and 300 c/s in the 1200–3400 c/s band.

Z: density of passages to zero below a certain threshold in the input signal.

Z': density of passages to zero below a certain threshold in the differentiated input signal.

The corresponding logic signals are respectively designated: u(t), m(t), M'(t), z(t) and z'(t).

The frequency range from 70 to 300 c/s includes the modulation frequencies of 110 and 220 c/s which are the mean vibration frequencies of the vocal cords respectively for a man and for a woman.

The criteria Z and Z' correspond to a spectrum in which formants are present; the formants are defined as a sequence in time of spectral components of equal or adjacent frequencies, and limit the number of the absolute or relative maxima in the spectrum of the speech.

The complex second test signal V is defined by level 1 of signal v(t) with $v(t)=u(t)\cdot[m(t)+m'(t)]+b(t)\cdot z(t)\cdot z'(t)$ It can be seen from this logic equation that sound is considered to be voiced in one and/or the other of the following cases:

(1) A modulating frequency comprised between 70 and 300 c/s has been detected and there is a sufficient energy difference between the 300–900 c/s and 1200–3400 c/s bands. In effect, the presence of a modulating frequency comprised between 70 and 300 c/s does not on its own enable this modulation to be attributed to the resonance frequency of the vocal cords. It could be due for example to a motor. However, in conjunction with the energy lack of balance, the criterion is good, as experience has shown.

(2) The second case provides for the presence of formants to be assumed with Z and Z'. However, experience has hown that it is good to add an energy condition in order to ensure that the spectrum in question is in fact due to formants and not to parasites.

Overall the criterion V at the instant t is a good criterion of the existence of signals representing a voiced sound.

The corresponding circuits will now be described.

Like FIG. 1, FIG. 2 shows the input 1, the delay line 2 and the switch 3.

The circuit which receives S(t) and which supplies the energy signal b(t) comprises two band pass filters 10 and 14 fed by the input 1. The bandwidth of the filter 10 extends from 300 to 900 c/s, whilst the bandwidth of the filter 14 extends from 1200 to 3400 c/s. The filter 10 is followed by a diode 11, a low-pass filter 12 with a cut-off frequency equal to 100 c/s and a comparator 13 which receives the output signal of the low-pass filter 12 at its "+" input and a positive reference threshold voltage $R_1$ at its "−" input. Disregarding the value of the reference voltage, the band pass filter 14 feeds an identical circuit comprising a diode 15, a low-pass filter 16 and a comparator 61 of which the "−" input receives a reference voltage $R_o$ below $R_1$. Like the other comparators which will be mentioned, the comparators 13 and 61 supply a signal 1 when the signal applied to their "+" input is stronger than the signal applied to their "−" input and a zero signal in the opposite case. The output of the comparators 13 and 61 are connected to the two inputs of an AND-gate 62 supplying the signal b(t). On the other hand, the outputs of the filters 12 and 16 are respectively connected to the "+" and "−" inputs of a subtractor 17 of which the output is connected to the "+" input of a comparator 18 of which the "−" input receives a third reference voltage $R_2$. This comparator supplies the signal u(t).

The outputs of the diodes 11 and 15 are respectively connected to the inputs of two band pass filters 19 and 20 with bandwidths extending from 70 to 300 c/s, respectively followed by two diodes 21 and 22.

These two diodes are respectively followed by two low-pass filters 23 and 24 with a cut-off frequency equal to 50 c/s.

The output signals of these last two filters are respectively connected to the "+" inputs of two comparators 25 and 26 of which the "−" inputs receive reference voltages $R_3$, $R_4$. A sufficiently high threshold of the output signal of the filter 23 or of the filter 24 is normally indicative of the presence of the modulation to a vocal resonance frequency around 110 c/s or 220 c/s. The comparator 25 and 26 respectively supply the signal m(t) and m'(t).

The input 1 is connected to the "+" input of a comparator 27 of which the "−" input is connected to ground. Each ascending front of the output signal of the comparator 27 releases a monostable trigger circuit 28 of which the output pulses are integrated by a low-pass filter 29 with a cut-off frequency equal to 50 c/s. The input 1 is connected to the input of a differentiator 30 followed by a circuit identical with the preceding circuit, namely a zero comparator 31, a monostable trigger circuit 32 and a low-pass filter 33.

The output signals of the filters 29 and 33 are respectively applied to the "−" inputs of two comparators 34 and 35 of which the "+" inputs receive two reference voltages $R_5$ and $R_6$, these two comparators respectively supplying z(t) and z'(t).

The dicision may be taken at fixed intervals with values of from 3 to 10 ms, for example 8 milliseconds, the signals b(t), u(t), m(t), m'(t), z(t) and z'(t), relative to the instant t, being sampled for this purpose in five type D trigger circuits 36 to 41 of which the clock inputs receive the pulses H with a duration of 8 ms.

The outputs of the trigger circuits 38 and 39 are connected to the two inputs of an OR gate 42 of which the output is connected to a first input of an AND-gate 43 of which the second input receives the signal U of the trigger circuit 37.

On the other hand, the sampled signals b(t), z(t) and z'(t) are applied to the inputs of a three-input AND-gate 44, the outputs of the AND-gates 43 and 44 being connected to the two inputs of an OR-gate 45 supplying the sampled signal v(t) because it is formed by means of sampled components. This sampled signal v(t) is assigned the same variable delay due to the sampling as its components and, in particular, as the sampled signal b(t).

The sampled signals b(t) and v(t) are respectively applied to the inputs of two shift registers 46 and 47 which receive the clock pulse H at their advance inputs, these two shift registers imparting to them delays respectively equal to D' and d.

The sampled signal v(t) and the corresponding delayed signals are applied to the two inputs of an OR-gate 48 of which the output signal, together with that of the register 47 supplying the delayed signal b(t), are applied to the two inputs of an AND-gate 49. The output of the AND-gate 49 is connected to the signal input of a type D trigger circuit 50 of which the clock input receives pulses H' phase-shifted by 4 ms relative to the pulses H. The output signal of the trigger circuit 50 is applied to the control input of the switch 3.

It will be noted that, in the embodiment shown in FIG. 2, the signals are subjected to two samplings, one relating to the input signals of the logic circuit and the other to the output signal, the sampling of the output signal being carried out with clock pulses phase-shifted by 4 ms relative to those which are used for sampling the input signals and the two series of pulses having a common period of 8 ms. These samplings are by no means necessary at the theoretical level. In practice, they provide for operation with stable signals in the logic circuit and for the use of an equally stable output signal. This sampling may result in a delay variable from 4 to 12 ms in a transition of the control signal in relation to a speech-noise or noise-speech transition in the output signal of the delay line. This delay may be analysed as a mean delay of 8 ms accompanied by a fluctuation of at most 4 ms in terms of absolute value. A fluctuation as short as this in a speech-noise transition is not troublesome. In a noise-speech transition, it generally does not interfere with the identification of an initial sound. With regard to the mean delay of 8 ms, it may be compensated through increasing by 8 ms the delay previously defined for D.

As concerns the time for auditively identifying an unvoiced consonant preceding or following a voiced sound it is hardly possible to take it less than 20 ms and for a more pleasant audition, will advantageously be taken as high as 60 ms. With embodiment of FIG. 2 the values which are thus determined may have to be slightly shifted to take into acount the fact that d and D must then be multiples of 8 ms.

In applications where it is necessary to discriminate between speech and acoustic noises present in the environment of the microphone, different sound recording techniques may be envisaged for facilitating the speech-/noise decision:directive in the case of medium-level ambient noise differential in the case of high-level ambient noise.

In this latter case, it is necessary to envisage the proximity of the microphone and the lips.

These techniques, mentioned as a reminder, are complementary to the invention.

Of course, the invention is not limited to the embodiment described and shown which was given solely by way of example.

What we claim, is:

1. An arrangement for discriminating speech signals from noise in an input signal, said arrangement comprising: a delay line for imparting to said input signal a delay of duration D, said delay line having at least one output; first means for generating a first test signal, indicative, with a limited degree of probability, of the presence of speech signals, voiced or unvoiced, in the signal appearing at said output of said delay line; second means, having an input for receiving said input signal, for generating a second test signal indicative, with a higher degree of probability, with a delay due to the response time of said second means, of the presence of voiced sound speech signals, in said input signal; third means for prolonging said second test signal by a duration d; and further means for delivering a speech decision signal, relative to the signal appearing at said output of said delay line, in the presence of both said first test signal and the prolonged second test signal; said duration D and d being taken sufficiently high for the duration of the prolonged second test signal to encompass on both sides the time interval during which the signals in response to which the second test signal was generated appear at said output of said delay line, the time elapsing between the beginning of the prolonged second test signal and the beginning of said time interval having a duration sufficient for the auditive identification of an unvoiced consonant preceding a voiced sound, and the time elapsing between the end of said time interval and the end of said prolonged second test signal having a duration sufficient for the auditive identification of an unvoiced consonant following a voiced sound.

2. A discriminating arrangement as claimed in claim 1, including logic means wherein each test signal is represented by a logic level of a logic signal.

3. A discriminating arrangement as claimed in claim 2, wherein said logic means process test signals including U being an elementary test signal corresponding to level 1 of a logic signal u(t), and denoting an energy imbalance above a threshold value between two acoustic frequency bands, M and M' being two elementary test signals respectively corresponding to level 1 of two logic signals m(t) and m'(t), and denoting, respectively in two acoustic frequency bands, the presence of a modulating frequency in a frequency band including the vibration frequencies of the vocal cords, Z and Z' being two elementary test signals respectively corresponding to level 1 of two logic signals z(t) and z'(t), and representing a density below a threshold value of the passages to zero respectively in the input signal and in the differentiated input signal, and B an elementary test signal corresponding to level 1 of a logic signal b(t), and denoting an energy above a threshold value in at least one acoustic frequency band, the second test signal V is level 1 of a logic signal v(t) with $v(t)=u(t)\cdot[m(t)+m'(t)]+b(t)\cdot z(t)\cdot z'(t)$.

4. A discriminating arrangement as claimed in claim 3, wherein the first test signal is level 1 of the signal obtained by means delaying the signal b(t).

* * * * *